United States Patent [19]

Lambert, Jr.

[11] 4,130,984

[45] * Dec. 26, 1978

[54] METHOD AND APPARATUS FOR MAKING NOVELTY YARN

[75] Inventor: John W. Lambert, Jr., Spartanburg, S.C.

[73] Assignee: Tuscarora Cotton Mill, Mount Pleasant, N.C.

[ * ] Notice: The portion of the term of this patent subsequent to Aug. 16, 1994, has been disclaimed.

[21] Appl. No.: 812,784

[22] Filed: Jul. 5, 1977

Related U.S. Application Data

[63] Continuation-in-part of Ser. No. 629,019, Nov. 5, 1975, Pat. No. 4,041,690.

[51] Int. Cl.[2] ..... D02G 3/34; D02G 3/36

[52] U.S. Cl. ..... 57/12; 19/238; 57/315; 57/91

[58] Field of Search ..... 57/36, 12, 90, 91, 38.3, 57/38.4, 140, 139, 156, 160; 19/238

[56] References Cited

U.S. PATENT DOCUMENTS

| | | | |
|---|---|---|---|
| 3,148,416 | 9/1964 | Hornbuckle | 57/91 X |
| 3,176,351 | 4/1965 | Keen | 57/91 X |
| 3,447,307 | 6/1969 | Rhyne | 57/91 X |
| 3,961,471 | 6/1976 | Allen | 57/91 X |
| 4,041,690 | 8/1977 | Lambert, Jr. | 57/91 X |

*Primary Examiner*—John Petrakes

*Attorney, Agent, or Firm*—Bell, Seltzer, Park & Gibson

[57] ABSTRACT

A method and apparatus for making a novelty yarn, having relatively short varying length and varying size auxiliary strands randomly distributed therealong, on a spinning frame provided with a series of spaced pairs of rotatable drafting elements defining a drafting zone, which drafting elements include a pair of delivery rolls. The novelty yarn is formed by advancing at least one strand of staple fibers into and through the drafting zone while continuously forming therefrom a ground strand of drafted staple fibers emerging from the delivery rolls. An auxiliary strand of staple fibers is fed through the nip of a pair of auxiliary feed rolls and to the nip of the delivery rolls while the auxiliary feed rolls are being rotated at a slower effective speed than the effective speed of the delivery rolls so as to effect a random parting of the auxiliary strand and thereby form relatively short varying length auxiliary strands randomly distributed along the ground strand. The ground strand and the randomly distributed auxiliary strand are twisted as they emerge from the delivery rolls to arrange the auxiliary strands spirally around the ground strand to form a novelty yarn therefrom. While the novelty yarn is being formed, the auxiliary strand is shielded from contacting the rotatable drafting elements immediately behind the delivery rolls during the travel of the auxiliary strand to the delivery rolls to thereby prevent the auxiliary strand from being misdirected rearwardly away from the delivery rolls.

22 Claims, 11 Drawing Figures

METHOD AND APPARATUS FOR MAKING NOVELTY YARN

This application is a continuation-in-part of my copending application Ser. No. 629,019, filed Nov. 5, 1975 and entitled NOVELTY YARN AND METHOD FOR MAKING SAME, now U.S. Pat. No. 4,041,690.

This invention relates to a method and apparatus for making novelty yarns of the type having lengths of auxiliary strands intertwisted with a ground strand to produce slubs, flakes or other novelty effects.

The novelty yarn of my copending application is formed of a ground strand of drafted staple fibers along which relatively short varying length auxiliary strands of staple fibers are randomly arranged in spaced relationship, with the auxiliary strands spirally twisted around the ground strand. The novelty yarn of said copending application is formed by advancing at least one strand of staple fibers into and through a drafting zone and drafting the fibers while continuously forming a ground strand of drafted staple fibers therefrom and while feeding an auxiliary strand of staple fibers through a pair of feed rolls into the delivery end of the drafting zone in such a manner as to effect a random parting of the auxiliary strand and thereby form relatively short varying length auxiliary strands randomly distributed along the ground strand. The ground strand and the randomly distributed auxiliary strands are intertwisted to arrange the auxiliary strands spirally around the ground strand and form the novelty yarn therefrom.

In instances in which an auxiliary strand of staple fibers is repeatedly parted in its travel into a drafting system through which a ground strand or base strand of staple fibers is being drafted, especially in the case of a spinning frame, the successive free end portions of such an auxiliary strand may, if not controlled, contact rotatable drafting elements; e.g., drafting rolls or aprons, immediately behind the particular drafting rolls to which the auxiliary strand is being directed, with the result that the rearwardly moving surface of the adjacent drafting element contacted by the auxiliary strand will sometimes misdirect the auxiliary strand rearwardly away from the particular drafting rolls to which the auxiliary strand is intended to be directed.

It is therefore an object of this invention to provide a method and apparatus for making a novelty yarn, having relatively short varying length and varying size auxiliary strands randomly distributed therealong, on a spinning frame, in substantially the manner heretofore described wherein the auxiliary strand is fed through the nip of a pair of auxiliary feed rolls to the nip of a pair of delivery rolls of the drafting zone through which the strand of staple fibers is being drafted for forming the ground strand, and while shielding the auxiliary strand from contacting the rotatable drafting elements immediately behind the delivery rolls during travel of the auxiliary strand to the delivery rolls to thereby prevent the auxiliary strand from being misdirected rearwardly away from the delivery rolls.

It is another object of this invention to provide a method and apparatus of the character described wherein the auxiliary strand is directed through a restricted passageway adjacent the delivery rolls to guide the auxiliary strand to the nip of the delivery rolls.

It is still another object of this invention to provide a method and apparatus of the character described wherein the shielding of the auxiliary strand from contacting the drafting element immediately behind the delivery rolls is effected by guidingly engaging the auxiliary strand during at least the major portion of its travel from the nip of the auxiliary feed rolls to the delivery rolls.

A further aspect of the invention involves a method and apparatus of the character described wherein the auxiliary feed rolls are continuously rotated at a slower effective speed than the effective speed of the delivery rolls.

It is a further object of this invention to provide a method and apparatus of the character described wherein the feed rolls are rotated intermittently for imparting a slower effective speed to the auxiliary feed rolls than the effective speed of the delivery rolls.

Some of the objects and features of the invention having been stated, other objects and features will appear as the description proceeds when taken in connection with the accompanying drawings, in which FIG. 1 is a schematic illustration of a spinning frame embodying a preferred apparatus for producing a novelty yarn in accordance with this invention;

Figure 3:
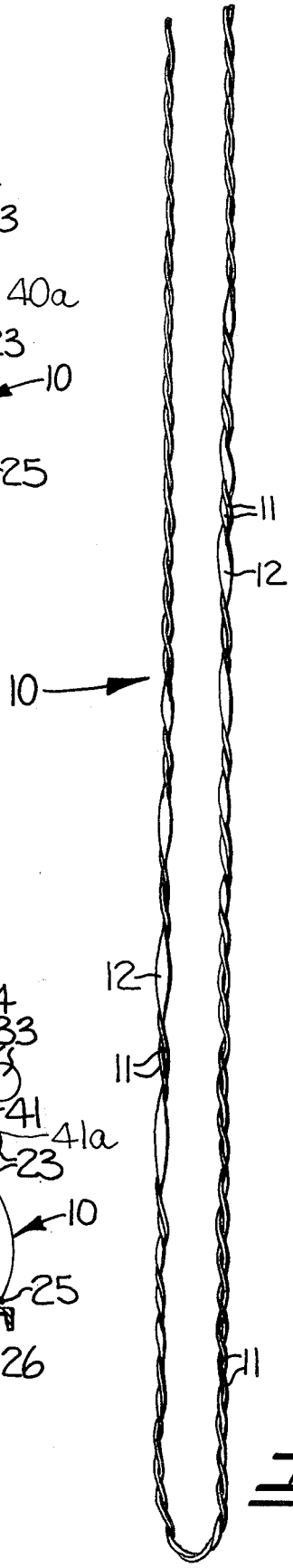
FIG. 3 is a view illustrating a portion of a novelty yarn formed in accordance with this invention.
Figure 4:
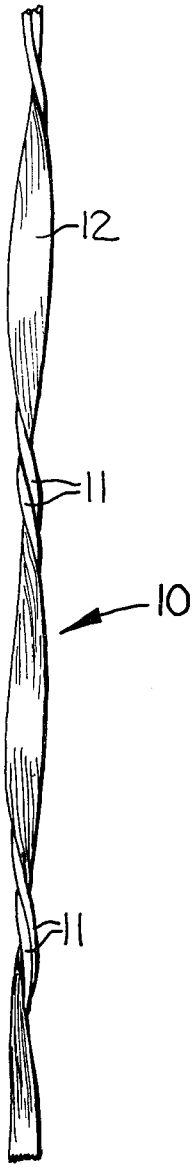
FIG. 4 is an enlarged fragmentary view of a portion of the yarn of FIG. 3.

Referring more specifically to the drawings, with particular reference to FIGS. 3 and 4, the novelty yarn produced according to this invention is generally designated at 10 and is illustrated as being of the type described and claimed in my said copending application, Ser. No. 629,019, to which reference is made for a more detailed disclosure thereof. As illustrated, the novelty yarn 10 comprises an elongate ground strand 11 of spun staple fibers with relatively short varying length and varying size auxiliary strands 12 being spirally twisted around the ground strand. The ground strand 11 may be formed of one or more strands of staple fibers, as desired. The auxiliary strands 12 are of varying length and of widely varying size and are randomly distributed along the length of the ground strand to produce various novelty effects.

It is preferred that the auxiliary strands 12 are of color characteristics differing from the ground strand 11 so that the various novelty effects will be more pronounced. The term "color characteristic" is used herein to refer to the characteristic of the strand or its constituent fibers which results in a difference in the color appearance of the strand. This includes fibers of different natural colors or differing light reflectivity, as resulting, for example, from differences in the type of fiber, composition, fiber cross-section, etc. This also includes strands whose fibers are different colors as a result of dyeing prior to formation of the novelty yarn. The term also includes fibers with differences in dye affinity and wherein dyeing is performed after formation of the novelty yarn with certain fibers of the yarn achieving a color different from other fibers of the yarn. The ground strand and the auxiliary strand may each be of a single color characteristic, as illustrated, or if desired, either one or both may be of multiple color characteristics. It is to be understood that all the strands of the novelty yarn may, if desired, be of the same color characteristic or kind without departing from the invention.

By way of example, the portion of the novelty yarn 10 illustrated in FIG. 4 may include a white ground strand 11, with the auxiliary strand 12 being of a contrasting darker color, for example, red. Referring to the portion of the yarn illustrated in FIG. 3, it will be observed that the medial portion of the auxiliary strand 12 shown in the lower portion of FIG. 3 has a relatively large number of fibers so arranged spirally around the ground strand 11 that adjacent turns or windings of the auxiliary strand substantially overlie and shield the underlying ground strand 11 from view. This results, as shown in FIG. 4, in the yarn having the predominant red color appearance of the auxiliary strand in this area. More particularly, it will be observed in FIG. 4 that the fibers of the auxiliary strand in this area are arranged spirally around the ground strand in the form of a ribbon or a relatively flattened band of fibers.

The auxiliary strand is also tapered or attenuated along its length with the number of fibers therein becoming less and less in the distal portions of the auxiliary strand approaching the terminal ends thereof in FIG. 3. The spiral turns of the auxiliary strand in these distal portions are not spaced as closely together as in the medial portion of this particular strand. Thus, both the ground strand and the auxiliary strand are individually discernible in these areas giving the yarn a multicolor "candy stripe" effect in these areas. The large number of fibers in these largest size auxiliary strands, particularly in the medial portions thereof results in an enlarged thickness portion or "flake" in the yarn further accentuating the color of the surrounding auxiliary strand. Further, the fibers of the auxiliary strand are relatively loosely bound to the underlying ground strand in these areas, resulting in increased fuzziness from the fibers of the auxiliary strand.

As disclosed in said copending application, because of the random parting of the auxiliary strand being fed to the delivery rolls of the drafting zone through which the strand of staple fibers is being drafted to form the ground strand around which the auxiliary strands are spirally arranged during the subsequent twisting operation, various sizes and lengths of the auxiliary strands are present in the novelty yarn so that, for example, intermediate size auxiliary strands and very small size auxiliary strands are arranged in spaced relationship, as well as the largest size auxiliary strands, and along the ground strand, with all the various sizes of auxiliary strands being arranged spirally around the ground strand. The intermediate size auxiliary strands have adjacent turns thereof spaced apart from one another along the ground strand so that both the ground strand and the auxiliary strand are individually discernible to give the yarn a multi-color effect in these areas. The very small size auxiliary strands, on the other hand, are formed of such a few number of fibers that, when they are arranged spirally around the ground strand, the smallest size auxiliary strands are barely discernible in the yarn when viewed without magnification. However, the contrasting color of the red fibers of the auxiliary strand against the white ground strand 11 in these areas results in slightly altering the color of the yarn.

Figure 1:
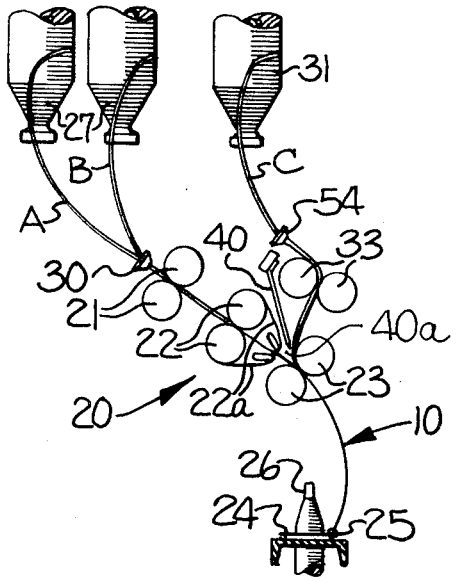

The novelty yarn heretofore described may be produced on any conventional spinning frame suitably modified in accordance with the present invention. Accordingly, there will be observed in FIGS. 1 and 2 two schematic embodiments of a ring spinning frame modified for production of the novelty yarn. Further details of the spinning frame of FIG. 1 are shown in FIGS. 5–9. Each spinning frame has a drafting system or zone 20 of the conventional type found on ring spinning frames and which comprises a series of spaced pairs of upper and lower rotatable drafting elements which are embodied in a pair of cooperating main feed rolls 21, a pair of intermediate cooperating drafting rolls 22, and a pair of cooperating front or delivery rolls 23. As preferred, the intermediate drafting rolls 22 may have conventional respective endless draft aprons or belts **22*a* entrained thereover. The draft aprons 22*a* also constitute rotary drafting elements and they extend forwardly from the intermediate drafting rolls 22, with their front portions being suitably supported behind and in closely spaced relation to the delivery rolls 23, as is usual. Each spinning frame is equipped with conventional twisting means which may take the form of a conventional spinning ring 24, a ring traveler 25, and a bobbin 26** on which the yarn is wound.

One or more strands of unspun staple fibers, such as a pair of strands of roving A, B, are withdrawn from respective supply sources or packages 27 by the rear drafting rolls or main feed rolls 21 as the strands of roving A, B are directed to the main feed rolls 21 through a suitable guide or trumpet 30. The strand or strands of unspun stable fibers are drafted through the successive pairs of drafting rolls 21, 22, 23 in a conventional manner to form a continuous ground strand 11 of drafted staple fibers emerging from the delivery rolls 23 and passing to the twisting means 24, 25, 26.

An auxiliary strand of roving C of unspun staple fibers is fed from a suitable supply source or package 31 and between a pair of auxiliary feed rolls 33 supported above and adjacent the delivery rolls 23 of the drafting zone 20, which is inclined downwardly and forwardly, as is usual. The rotatable drafting elements, including the pairs of drafting rolls 21–23 and the aprons **22*a*, of each embodiment of the spinning frame shown in FIGS. 1 and 2**, may be driven by any suitable or conventional driving mechanism such as that indicated schematically at 35 in FIG. 5. Also, in accordance with the present invention, two embodiments of novel driving means are provided, which will be later described, for transmitting rotation from at least one of the rotatable drafting elements to the auxiliary feed rolls 33 for rotating the same at an effective speed less than the effective speed of the delivery rolls 23. The auxiliary feed rolls 33 are so positioned that the nip thereof is spaced from the nip of the delivery 23 a distance greater than the staple length of the auxiliary strand C which is introduced into the nip of the delivery rolls 23 so as to be intertwisted with the ground strand 11 emerging from the delivery rolls 23.

The effective speed of the auxiliary feed rolls 33 is such with respect to the effective speed of the delivery rolls 23 that the auxiliary roving C is drafted so much as to be broken, ruptured, or parted randomly and periodically at weak points in the auxiliary strand. Thus, relatively short random length auxiliary strands 12 are formed and randomly distributed along the ground strand 11 so that the ground strand and the thus randomly distributed auxiliary strands are twisted as they emerge from the delivery rolls 23 of each drafting zone to arrange the auxiliary strands 12 spirally around the ground strand 11 and form the novelty yarn 10 therefrom.

Figure 2:
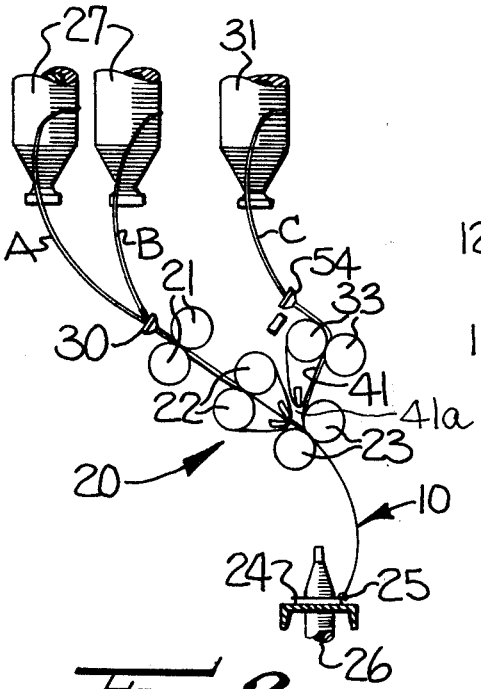
FIG. 2 is a schematic view of a spinning frame embodying another form of apparatus for producing a novelty yarn in accordance with this invention.

The spinning frames of FIGS. 1 and 2 are provided with two different embodiments of shielding means 40, 41 respectively, which are peculiar to the present invention and which are so positioned adjacent the respective drafting zones 20, 20 as to shield each respective auxiliary strand C from contacting the rotating drafting elements (22 or 22*a*, as the case may be) immediately behind the corresponding delivery rolls 23 during the travel of the auxiliary strand to the delivery rolls to thereby prevent the auxiliary strand from being misdirected rearwardly away from the delivery rolls. However, before describing the shielding means 40, 41 in detail, a description of supporting means for the auxiliary feed rolls 33 will be described, since such supporting means is also instrumental in supporting the shielding means, in each instance.

Figure 5:
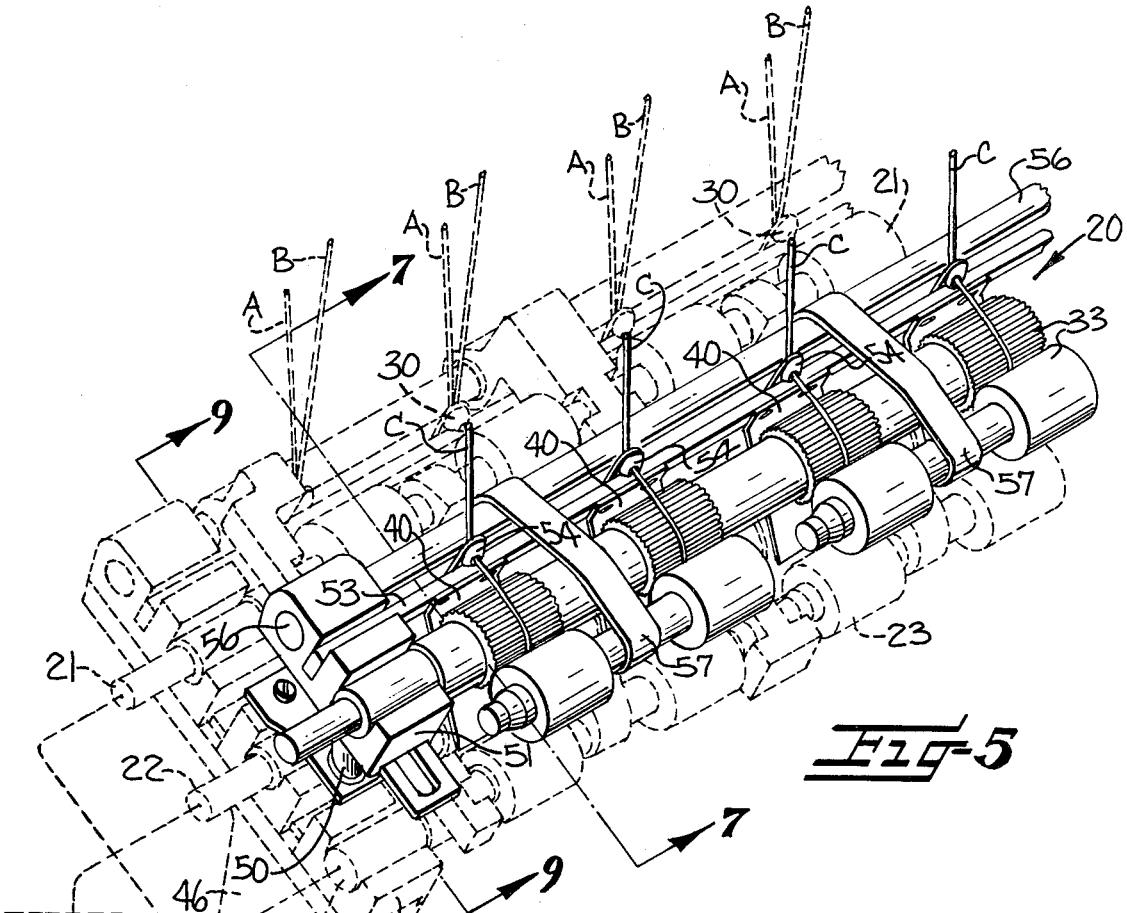
FIG. 5 is an enlarged fragmentary perspective view further schematically illustrating the spinning frame of FIG. 1.
Figure 6:
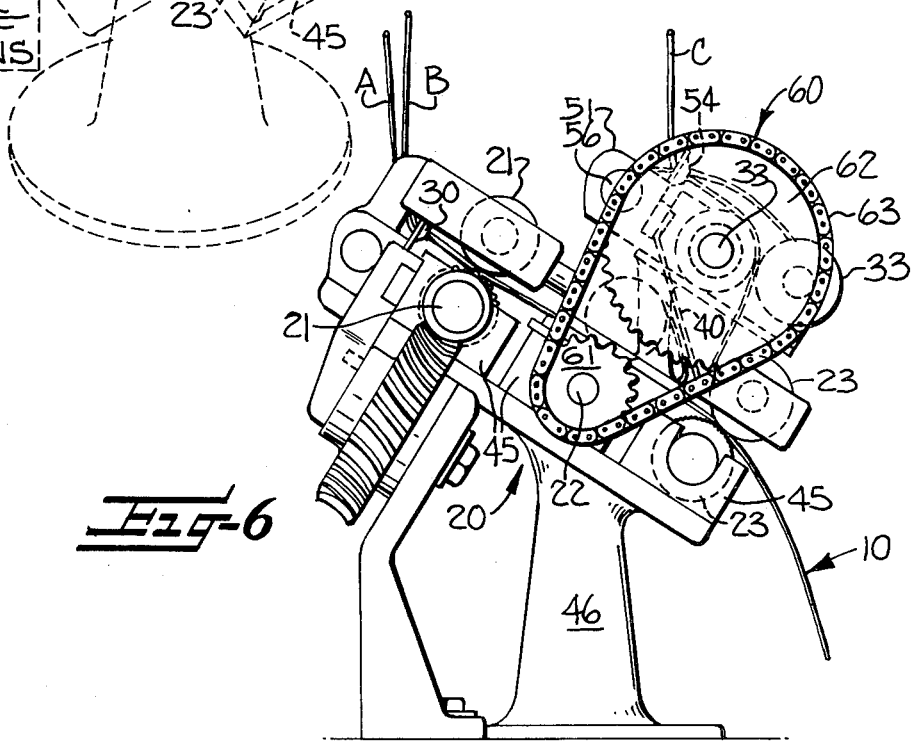
FIG. 6 is a fragmentary end view of the drafting system of the spinning frame shown in FIG. 5 and illustrating one form of means for imparting rotation to the auxiliary feed rolls of the apparatus.
Figure 9:
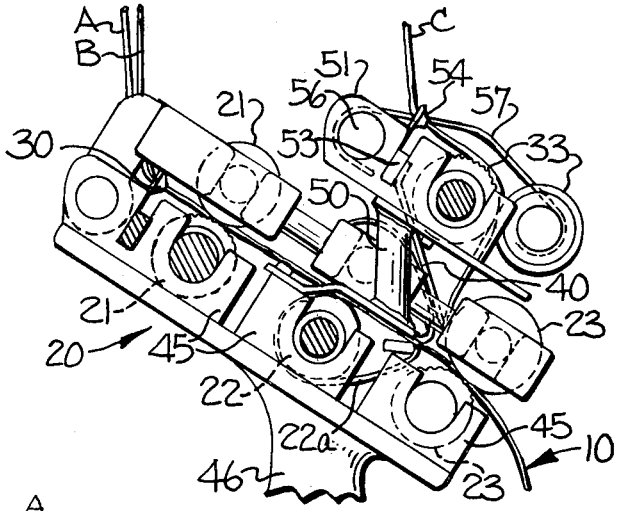
FIG. 9 is a fragmentary vertical sectional view taken substantially along line 9—9 in FIG. 5 and particularly illustrating the means for supporting the auxiliary feed rolls above the drafting zone.

Referring to FIGS. 5, 6, and 9, it will be observed that the lower drafting rolls of the spinning frame there shown, which corresponds to the spinning frame of FIG. 1, are journaled in bearing blocks 45 suitably secured on the upper downwardly and forwardly inclined surfaces of conventional roll stands 46, only one of which is shown in each of the FIGS. 5, 6, and 9, it being noted that each of the bottom drafting rolls extends longitudinally through and forms an element of each of a plurality of parallel drafting zones, as is conventional. The upper drafting rolls may be supported in a conventional manner, and thus need not be described further in detail.

As best shown in FIGS. 5 and 9, the centermost bearing block for the bottom intermediate drafting roll 22 on the respective roll strand 46, has a lower portion of a respective auxiliary roll stand 50 suitably secured thereto. The auxiliary roll stand 50 has a downwardly and forwardly inclined upper surface on which is secured a bearing block 51, in a medial portion of which a corresponding reduced end portion of the rearmost of the corresponding pair of auxiliary feed rolls 33 is rotatably supported. One or more additional auxiliary roll stands and corresponding bearing blocks similar to the roll stand 50 and bearing block 51, although not shown, are positioned on the next adjacent group of bearing blocks 45 and the corresponding roll stand 46 for supporting the distal end of the rearmost auxiliary feed roll 33.

The auxiliary roll stand bearing block 51, and the other bearing block or blocks corresponding thereto, not shown, also support a bar 53 on which guide eyes 54 for the auxiliary roving strands are suitable secured. Also, the auxiliary roll stand bearing blocks 51 support a rear rod member 56 which carries suitable spring clips 57 thereon. The spring clips 57 extend forwardly over the portions of the rearmost auxiliary feed roll 33 between the bosses thereof, and these spring clips 57 serve to support the frontmost auxiliary feed roll 33 in pressure engagement with and forwardly of the respective rearmost auxiliary feed roll 33.

Figure 7:
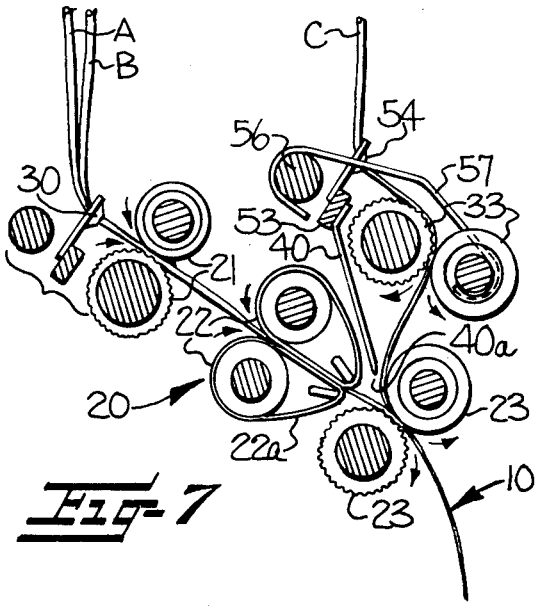
FIG. 7 is a fragmentary vertical sectional view taken substantially along line 7—7 in FIG. 5 and particularly illustrating a preferred form of shielding means spaced between the auxiliary feed rolls and the drafting elements located immediately behind the delivery rolls of the drafting zone.
Figure 8:
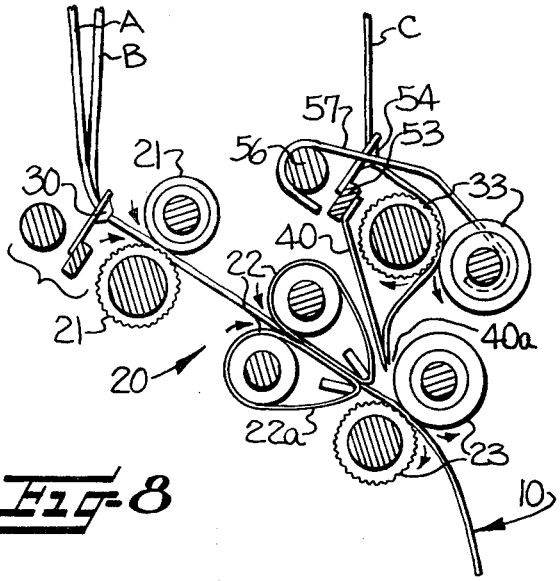
FIG. 8 is a view similar to FIG. 7 illustrating how the shielding means functions to prevent the free leading end of the auxiliary strand of staple fibers from contacting the drafting elements or aprons immediately behind the delivery rolls of the drafting zone so as to prevent the auxiliary strand from being misdirected rearwardly away from the delivery rolls.

Referring now to FIGS. 1, 7, and 8 in particular, it will be observed that the first embodiment of the shielding means 40 comprises a downwardly and forwardly inclined plate means which overlies each respective drafting zone 20 and extends downwardly and forwardly at an angle in spaced relation to the rearmost auxiliary feed roll and those rotatable drafting elements immediately behind the delivery rolls 23, which happen to be the aprons 22*a*, in this instance. However, the plate means 40 is located between the auxiliary feed rolls and the drafting elements immediately behind the delivery rolls so that it serves the aforementioned function of shielding the auxiliary strand C from contacting the rotatable drafting elements immediately behind the delivery rolls during the travel of the auxiliary strand to the delivery rolls.

Additionally, as best shown in FIGS. 7 and 8, it will be observed that the plate means has a forward or lower edge terminating closely adjacent that delivery roll 23 nearest the auxiliary feed rolls 33, and the forward edge of the plate means 40 cooperates with the adjacent delivery roll 23 to define therebetween a restricted passageway 40*a* for guiding the auxiliary strand C into the nip of the delivery rolls 23. In this regard, it will be observed in FIG. 7 that the portion of the auxiliary strand C extending from the nip of the auxiliary feed rolls 33 to the nip of the delivery rolls 23 is being drafted or stretched, but has not yet been parted or ruptured by the pull on the auxiliary strand of roving C.

However, it will be observed in FIG. 8 that the auxiliary strand of roving C has, in fact, been ruptured, and it will also be observed that the free leading end of the auxiliary strand C, rearwardly of the delivery rolls 23, has engaged the lower portion of the plate means or shield means 40. Thus, it can be appreciated that the plate means 40 serves as a barrier between the path of travel of the auxiliary strand C to the delivery rolls, and the rotatable drafting elements immediately behind the delivery rolls, thus shielding the auxiliary strand from contacting the last-mentioned rotatable drafting elements and thereby preventing the auxiliary strand from being misdirected rearwardly away from the delivery rolls 23 by the drafting elements immediately behind the delivery rolls 23. Additionally, it can be appreciated that the leading or lower portion of the plate means 40 serves to guide the free lower portion of the auxiliary strand C in FIG. 8 into the passageway 40*a* and thus to the nip of the delivery rolls 23 preparatory to a subsequent segment or length of the auxiliary strand C being pulled therefrom by the corresponding delivery rolls 23.

In the embodiment of the spinning frame shown in FIG. 2, the shielding means 41 takes the form of an endless belt apron instead of a plate means as in FIGS.

1 and 7–9. The endless belt apron 41 is entrained over the rearmost of the two auxiliary feed rolls 33, with the forward run or reach of the endless belt apron 41 extending downwardly from the nip of the auxiliary feed rolls 33 and being suitably supported so that its forward or lowermost portion terminates closely adjacent the delivery rolls. Thus, it can be appreciated that the apron 41 constitutes a strand guide means adapted to guidingly engage the auxiliary strand C during at least the major portion of its travel forwardly from the nip of the auxiliary feed rolls 33 to the delivery rolls 23 in FIG. 2.

It is also apparent that, since the forward portion of the endless belt apron 41 terminates closely adjacent the delivery rolls, the forward portion of the endless belt apron and the adjacent or uppermost delivery roll 23 define therebetween a restricted passageway 41*a* serving to direct the auxiliary strand into the nip of the delivery rolls in the same manner in which the restricted passageway 40*a* of the embodiment of FIG. 1 functions. Since the embodiment of the shielding means and the spinning frame shown in FIG. 2 may be constructed and operated in substantially the same manner as the embodiment of FIGS. 1 and 7–9, with the exception of the differences in the construction of the shielding means 40, 41 heretofore described, a further more detailed description of the spinning frame embodiment of FIG. 2, and the associated shielding means 41 is deemed unnecessary.

As indicated earlier herein, means are provided for driving the auxiliary feed rolls 33, above the drafting zone of each spinning frame, at a slower effective speed than the effective speed of the corresponding delivery rolls 23 to thereby rupture the corresponding auxiliary strands C by pulling the same apart so as to form relatively short varying length auxiliary strands for being distributed along the ground strand. Two embodiments of means for driving the auxiliary feed rolls 33 will be presently described, one embodiment of the driving means being arranged for continuously transmitting rotation from the rotatable drafting elements of the corresponding drafting zone 20 to the auxiliary feed rolls 33, and the other embodiment of the driving means including means for intermittently transmitting rotation from the corresponding rotatable drafting elements to the auxiliary feed rolls 33.

As shown in FIG. 6, the driving means 60 for transmitting continuous rotation to the auxiliary feed rolls 33 constitutes driving connections drivingly connecting one of the rotatable drafting elements to the auxiliary feed rolls 33 and may take the form of sprocket and chain connections comprising sprocket wheels 61, 62 suitably secured on corresponding reduced ends of one of the intermediate drafting rolls 22 and one of the auxiliary feed rolls 33, respectively. As preferred, sprocket wheel 61 is fixedly mounted on the corresponding reduced end portion of the lower intermediate drafting roll 22, and sprocket wheel 62 is fixedly mounted on the corresponding reduced end of the rearmost auxiliary feed roll 33.

A sprocket chain 63 is entrained over the sprocket wheels 61, 62 for transmitting rotation from the intermediate bottom drafting roll 22 to the auxiliary feed rolls 33. The sprocket wheel 62 is shown in FIG. 6 as being substantially larger than the sprocket wheel 61, thus indicating that the auxiliary feed rolls 33 are driven to rotate at a slower speed than the intermediate drafting rolls 22. It is apparent that, since the delivery rolls 23 are necessarily driven at a substantially faster peripheral speed than that of the intermediate drafting rolls 22, the delivery rolls also will be rotating at a substantially faster effective speed than that of the auxiliary feed rolls 33. In any event, it is apparent that the sizes of the sprocket wheels 61, 62 may be readily determined by a skilled mechanic in order to effect rotation of the auxiliary feed rolls 33 at the desired relatively slower effective speed than that of the delivery rolls 23.

Figure 10:
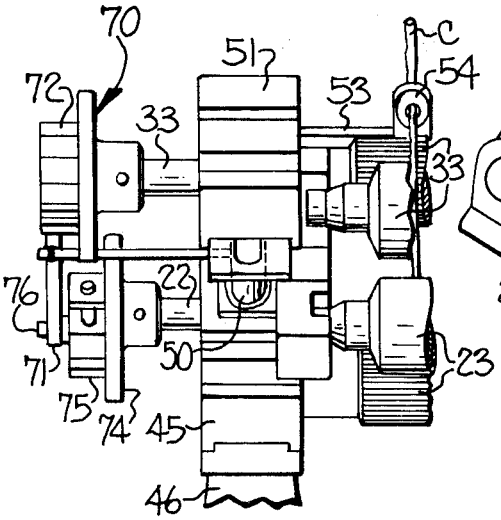
FIG. 10 is a front elevation of the left-hand end portion of FIG. 5 and particularly illustrating another form of means for transmitting rotation to the auxiliary feed rolls and being particularly devised for imparting intermittent rotation thereto.
Figure 11:
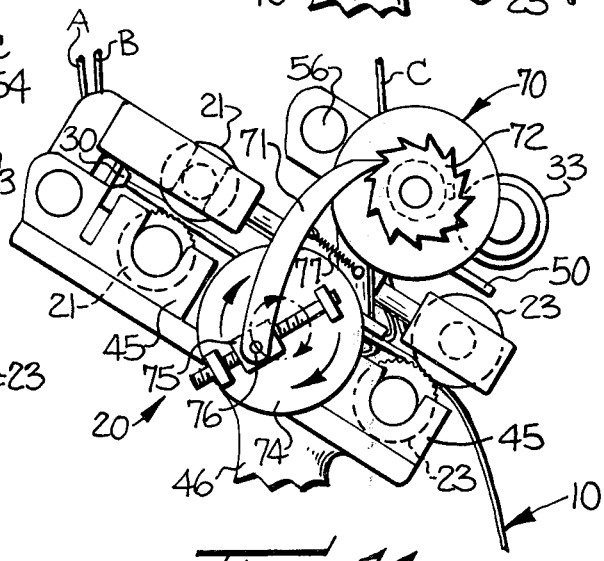
FIG. 11 is a fragmentary view looking at the left-hand side of FIG. 10.

Referring to FIGS. 10 and 11, portions of a spinning frame are there shown as being substantially the same as the spinning frame heretofore described with particular reference to FIGS. 1 and 5–9. Of course, the spinning frame of FIGS. 10 and 11 is provided with a different form of driving means for the auxiliary feed rolls than that shown in FIG. 6. However, the various parts of the spinning frame shown in FIGS. 10 and 11 will bear the same reference characters as are applied to similar parts shown in FIGS. 1 and 5–9, where applicable, to avoid repetitive description.

The driving means for the auxiliary feed rolls 33 in FIGS. 10 and 11 is broadly designated at 70 and is devised for transmitting intermittent or stepwise rotation from the rotatable drafting elements to the auxiliary feed rolls 33. It should be noted that, although the auxiliary feed rolls 33 may be rotated at a faster surface speed than that of the delivery rolls 23 during each intermittent or stepwise rotational movement thereof, if desired, the overall, effective, rotational speed of the auxiliary feed rolls 33 is slower than the effective speed of the delivery rolls 33 in FIGS. 10 and 11.

The driving means 70 of FIGS. 10 and 11 is illustrated in the form of a ratchet mechanism including a ratchet pawl 71 and a ratchet wheel 72. The lower end portion of ratchet pawl 71, remote from ratchet wheel 72, is pivotally mounted in offset or eccentric relation to the reduced adjacent end portion of the bottom intermediate drafting roll 22, as by means of a rotary member or disk 74, fixed on said reduced end portion of the intermediate bottom drafting roll 22, and having mounted thereon a radially adjustable block 75 to which the lower portion of ratchet pawl 71 is pivotally connected, as at 76. A suitable spring means 77 is connected to a medial portion of ratchet pawl 71 for urging the free upper end thereof into engagement with the peripheral teeth of ratchet wheel 72.

Ratchet wheel 72 is suitably secured on the corresponding reduced end of the rearmost of the auxiliary feed rolls 33. Thus, it is apparent that the rotatable bottom intermediate drafting roll 22 transmits reciprocatory motion to ratchet pawl 71 which, in turn, imparts stepwise or intermittent rotational motion to ratchet wheel 72 and thus to the auxiliary feed rolls 33 in FIGS. 10 and 11.

From the foregoing description, it can be seen that I have provided a method of making a novelty yarn on a spinning frame which comprises advancing at least one strand of staple fibers into and through a drafting zone while continuously forming a ground strand of drafted staple fibers emerging from the delivery rolls of the drafting zone, while feeding an auxiliary strand of staple fibers through the nip of a pair of auxiliary feed rolls and to the nip of the delivery rolls, and wherein the auxiliary feed rolls are rotated at a slower effective speed than the effective speed of the delivery rolls so as to effect a random parting or rupturing of the auxiliary strand and thereby form relatively short varying length auxiliary strands randomly distributed along the ground strand. It is seen further that I have provided a method in which the auxiliary strand is shielded from contacting the rotatable drafting elements immediately behind the delivery rolls of the drafting zone during the travel of the auxiliary strand to the delivery rolls to thereby prevent the auxiliary strand from being misdirected rearwardly away from the delivery rolls, and wherein the ground strand and the randomly distributed auxiliary strands are twisted as they emerge from the delivery rolls to arrange the auxiliary strands spirally around the ground strand and form a novelty yarn therefrom.

It is also seen that I have provided a novel apparatus for carrying out the method above described including shielding means, in the form of plate means or an endless belt apron, adjacent the drafting zone and being so positioned as to shield the auxiliary strand from contacting the rotating drafting elements immediately behind the delivery rolls during the travel of the auxiliary strand to the delivery rolls.

It is seen further that I have provided apparatus of the character described wherein means are provided for either continuously or intermittently driving the auxiliary feed rolls at a slower effective speed than the effective speed of the delivery rolls so as to effect the aforementioned random pulling apart or rupturing of the auxiliary strand in its travel between the auxiliary feed rolls and the delivery rolls.

In the drawings and specification there have been set forth preferred embodiments of the invention, and although specific terms are employed, they are used in a generic and descriptive sense only, and not for purposes of limitation.

That which is claimed is:

1. A method of making a novelty yarn, having relatively short varying length and varying size auxiliary strands randomly distributed therealong, on a spinning frame having a series of spaced pairs of rotatable drafting elements defining a drafting zone and wherein the pairs of drafting elements include a pair of delivery rolls, said method comprising advancing at least one strand of staple fibers into and through the drafting zone while continuously forming therefrom a ground strand of drafted staple fibers emerging from the delivery rolls, feeding an auxiliary strand of staple fibers through the nip of a pair of auxiliary feed rolls and to the nip of the delivery rolls, while rotating the auxiliary feed rolls at a slower effective speed than the effective speed of the delivery rolls so as to effect a random parting of the auxiliary strand and thereby form relatively short varying length auxiliary strands randomly distributed along the ground strand, while also shielding the auxiliary strand from contacting the rotatable drafting elements immediately behind the delivery rolls during the travel of the auxiliary strand to the delivery rolls to thereby prevent the auxiliary strand from being misdirected rearwardly away from the delivery rolls, and twisting the ground strand and the randomly distributed auxiliary strands as they emerge from the delivery rolls to arrange the auxiliary strands spirally around the ground strand and form a novelty yarn therefrom.

2. A method according to claim 1 wherein the shield of the auxiliary strand from contacting the drafting elements immediately behind the delivery rolls during its travel to the delivery rolls includes directing the auxiliary strand through a restricted passageway adjacent the delivery rolls to guide the auxiliary strand to the nip of the delivery rolls.

3. A method according to claim 1 wherein the shielding of the auxiliary strand from contacting the drafting elements immediately behind the delivery rolls during its travel to the delivery rolls includes guidingly engaging the auxiliary strand during at least the major portion of its travel from the nip of the auxiliary feed rolls to the delivery rolls.

4. A method according to claim 1 wherein the rotating of the auxiliary feed rolls at a slower effective speed than the effective speed of the delivery rolls includes rotating the auxiliary feed rolls continuously.

5. A method according to claim 1 wherein the rotating of the auxiliary feed rolls at a slower effective speed than the effective speed of the delivery rolls includes rotating the auxiliary feed rolls intermittently.

6. A method of making a novelty yarn, having relatively short varying length and varying size auxiliary strands randomly distributed therealong, on a spinning frame having a series of spaced pairs of rotatable drafting elements defining a drafting zone and wherein the pairs of drafting elements include a pair of main feed rolls, a pair of drafting aprons, and a pair of delivery rolls, said method comprising advancing at least one strand of staple fibers into and through the drafting zone for forming therefrom a ground strand of drafted staple fibers emerging from the delivery rolls, feeding an auxiliary strand of staple fibers through the nip of a pair of auxiliary feed rolls and to the nip of the delivery rolls, while rotating the auxiliary feed rolls at a slower effective speed than the effective speed of the delivery rolls so as to effect a random parting of the auxiliary strand and thereby form relatively short varying length auxiliary strands randomly distributed along the ground strand, while also shielding the auxiliary strand from contacting the drafting aprons during the travel of the auxiliary strand to the delivery rolls to thereby prevent the auxiliary strand from being misdirected rearwardly away from the delivery rolls, and twisting the ground strand and the randomly distributed auxiliary strands as they emerge from the delivery rolls to arrange the auxiliary strands spirally around the ground strand and form a novelty yarn therefrom.

7. A method according to claim 6 wherein the shielding of the auxiliary strand from contacting the drafting aprons during its travel to the delivery rolls includes directing the auxiliary strand through a restricted passageway adjacent the delivery rolls to guide the auxiliary strand to the nip of the delivery rolls.

8. A method according to claim 6 wherein the shielding of the auxiliary strand from contacting the drafting aprons during its travel to the delivery rolls includes guidingly engaging the auxiliary strand during at least the major portion of its travel from the nip of the auxiliary feed rolls to the delivery rolls.

9. A method according to claim 6 wherein the rotating of the auxiliary feed rolls at a slower effective speed than the effective speed of the delivery rolls includes rotating the auxiliary feed rolls continuously.

10. A method according to claim 6 wherein the rotating of the auxiliary feed rolls at a slower effective speed than the effective speed of the delivery rolls includes rotating the auxiliary feed rolls intermittently.

11. In a spinning frame for making novelty yarn and having means defining a drafting zone for drafting therethrough at least one strand of staple fibers to form a ground strand therefrom, said means comprising a series of spaced pairs of rotatable drafting elements including a pair of driven cooperating delivery rolls, and twisting means cooperating with said drafting elements for imparting twist to the ground strand as it emerges from said delivery rolls; the combination therewith of a pair of auxiliary feed rolls adjacent said delivery rolls and being adapted to feed an auxiliary strand of staple fibers to the nip of the delivery rolls, means for driving said auxiliary feed rolls at a slower effective speed than the effective speed of said delivery rolls such as to effect a random pulling apart of the auxiliary strand in its travel between the auxiliary feed rolls and the delivery rolls and to thereby form relatively short varying length auxiliary strands for being distributed along the ground strand and spirally twisted around the ground strand by said twisting means for making the novelty yarn therefrom, and shielding means adjacent said drafting zone and being so positioned as to shield the auxiliary strand from contacting the rotating drafting elements immediately behind the delivery rolls during the travel of the auxiliary strand to the delivery rolls to prevent the auxiliary strand from being misdirected rearwardly away from the delivery rolls.

12. Apparatus according to claim 11 wherein said shielding means includes plate means positioned between those drafting elements immediately behind the delivery rolls and the auxiliary feed rolls.

13. Apparatus according to claim 12 wherein said plate means has a forward edge closely adjacent the delivery roll nearest said feed rolls and wherein said edge and said delivery roll define therebetween a restricted passageway for guiding the auxiliary strand into the nip of the delivery rolls.

14. Apparatus according to claim 11 wherein said shielding means comprises strand guide means adapted to guidingly engage the auxiliary strand during at least the major portion of its travel forwardly from the nip of the auxiliary feed rolls to the delivery rolls.

15. Apparatus according to claim 14 wherein said strand guide means includes as endless belt apron entrained over one of said auxiliary feed rolls and having a forward portion terminating closely adjacent the delivery rolls.

16. Apparatus according to claim 15 wherein said forward portion of said apron and the adjacent delivery roll define therebetween a restricted passageway serving to direct the auxiliary strand into the nip of the delivery rolls.

17. Apparatus according to claim 11 wherein said means for driving said auxiliary feed rolls at a slower effective speed than the effective speed of said delivery rolls comprises means for continuously transmitting rotation from at least one of said rotatable drafting elements to said auxiliary feed rolls.

18. Apparatus according to claim 11 wherein said means for driving said auxiliary feed rolls at a slower effective speed than the effective speed of said delivery rolls includes means for intermittently transmitting rotation from at least one of said rotatable drafting elements to said auxiliary feed rolls.

19. In a spinning frame for making novelty yarn and having means defining a drafting zone for drafting therethrough at least one strand of staple fibers to form a ground strand therefrom, said means including a pair of driven cooperating feed rolls, a pair of driven cooperating intermediate rolls spaced forwardly of said feed rolls and having respective draft aprons entrained thereover and extending forwardly therefrom, and a pair of driven cooperating delivery rolls forwardly of said aprons, and twisting means cooperating with said rolls for imparting twist to the ground strand as it emerges from said delivery rolls; the combination therewith of a pair of auxiliary feed rolls above and adjacent said aprons and said delivery rolls and being so positioned as to feed an auxiliary strand of staple fibers therefrom to the nip of the delivery rolls, means for driving said auxiliary feed rolls at a slower effective speed than that of said delivery rolls such as to effect a random pulling apart of the auxiliary strand in its travel between the auxiliary feed rolls and the delivery rolls and to thereby form relatively short varying length auxiliary strands for being distributed along and spirally twisted around the ground strand by said twisting means for making the novelty yarn therefrom, and shielding means positioned between the draft aprons and the path of travel of the auxiliary strand to the delivery rolls so as to shield the auxiliary strand from contacting the adjacent draft apron during the travel of the auxiliary strand to the delivery rolls to thereby prevent the auxiliary strand from being misdirected rearwardly away from the delivery rolls.

20. Apparatus according to claim 19 wherein said shielding means includes plate means positioned between the auxiliary feed rolls and said adjacent draft apron.

21. Apparatus according to claim 19 wherein said shielding means comprises strand guide means adapted to guidingly engage the auxiliary strand during at least a major portion of its travel forwardly from the nip of said auxiliary feed rolls to the delivery rolls.

22. Apparatus according to claim 21 wherein said strand guide means includes an endless belt apron entrained over one of said auxiliary feed rolls and having a forward portion thereof terminating closely adjacent the delivery rolls.

* * * * *

UNITED STATES PATENT AND TRADEMARK OFFICE

CERTIFICATE OF CORRECTION

PATENT NO. : 4,130,984

DATED : December 26, 1978

INVENTOR(S) : John W. Lambert, Jr.

It is certified that error appears in the above-identified patent and that said Letters Patent are hereby corrected as shown below:

Column 5, Line 9, after "delivery" insert --rolls--; same column, Line 57, change "strand" to --stand--. Column 6, Line 6, change "suitable" to --suitably--. Column 8, Line 30, change "33" to --23--. Column 9, CLAIM 2, Line 60, change "shield" to --shielding--

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*